United States Patent [19]

Dyment et al.

[11] Patent Number: 4,663,943

[45] Date of Patent: May 12, 1987

[54] ARTICLE DISPLAY APPARATUS

[75] Inventors: James A. Dyment, New Richmond; Norbert C. Albers; Harvey W. Benison, both of Cincinnati; Karl E. Haschart; John S. Veach, both of Cincinnati, all of Ohio

[73] Assignee: Dyment Limited, Toronto, Canada

[21] Appl. No.: 764,989

[22] Filed: Aug. 12, 1985

[51] Int. Cl.[4] ..... A47F 3/04

[52] U.S. Cl. ..... 62/250; 62/378; 62/381; 221/278

[58] Field of Search ..... 221/82, 150 R, 155, 221/298; 62/250, 248, 297, 381, 378; 312/36

[56] References Cited

U.S. PATENT DOCUMENTS

| | | | |
|---|---|---|---|
| 1,719,146 | 7/1929 | Stringer . | |
| 1,883,961 | 10/1932 | Kosmerl | 62/297 |
| 1,905,180 | 4/1933 | Lowther | 221/82 |
| 1,923,032 | 8/1933 | Frick et al. | 221/82 |
| 1,934,133 | 11/1933 | Lauderback . | |
| 2,013,901 | 9/1935 | Shankland . | |
| 2,176,823 | 10/1939 | Richardson . | |
| 2,435,177 | 1/1948 | Connell et al. | 62/381 X |
| 2,647,029 | 7/1953 | Deland | 221/155 |
| 2,672,735 | 3/1954 | Fusselman . | |
| 2,706,387 | 4/1955 | Swanson . | |
| 2,791,889 | 5/1957 | Childers | 62/381 |
| 2,986,019 | 5/1961 | Happer | 62/250 |
| 3,025,681 | 3/1962 | Booth | 62/248 |
| 3,115,019 | 12/1963 | Rutishauser | 62/256 |
| 3,179,289 | 4/1965 | Moyer et al. | 221/121 |
| 3,306,068 | 2/1967 | Allgeyer et al. | 62/256 |
| 3,365,907 | 1/1968 | Barroero | 62/256 |
| 3,410,385 | 11/1968 | Freet et al. | 194/39 |
| 3,462,966 | 8/1969 | Reid et al. | 62/248 |
| 3,627,395 | 12/1971 | Hoey | 312/125 |
| 3,712,507 | 1/1973 | Holt | 221/82 |
| 3,769,805 | 11/1973 | Corini | 62/3 |
| 4,267,706 | 5/1981 | Abraham | 62/256 |
| 4,314,458 | 2/1982 | Hade et al. | 62/256 |
| 4,373,355 | 2/1983 | Monroe | 62/256 |
| 4,449,761 | 5/1984 | Davis et al. | 312/116 |

*Primary Examiner*—Lloyd L. King

*Attorney, Agent, or Firm*—Wood, Herron & Evans

[57] ABSTRACT

A portable, refrigerated article display apparatus for displaying food items such as soda cans includes a hollow housing having a transparent outer wall, a base support for mounting the housing, a door mounted over an access opening in the transparent outer wall and systems for cooling the housing interior and defogging its transparent outer wall. Articles are stacked in vertical columns within the housing interior upon an article support carriage which is rotatable with respect to the fixed base and housing to index each vertical column of articles into direct alignment with the door. In removing articles from the housing, the door is operable in an open position to permit removal of the lower most article in the column while supporting the articles above. The remaining articles in the column are released in preparation for removal of another article upon closing the door.

44 Claims, 8 Drawing Figures

ARTICLE DISPLAY APPARATUS

BACKGROUND OF THE INVENTION

This invention relates to an article display apparatus, and more particularly to a portable display unit for dispensing articles such as soda cans in which the articles are stacked in vertical columns within a transparent housing.

The marketing concept commonly known as "impulse" buying has been effectively used in a variety of retail establishments, including supermarkets and convenience food stores. The idea behind impulse buying is that customers must see certain products before they are motivated to buy. In order to promote impulse buying, such products must be displayed attractively and at a location in the store which most customers are likely to pass by.

One aspect of impulse buying, particularly for food products requiring refrigeration, has been the development of article displays having transparent doors or walls with shelves angled upwardly from front to back so that all articles on the shelves may be seen by customers. Refrigerated display devices most commonly in use today are typically wall-mounted units having clear glass doors which open to an interior provided with a number of angled shelves filled with product.

Permanent wall-mounted article display devices of the type described above present several limitations from the standpoint of promoting effective impulse buying. Only the front panel or door of such display devices is clear and thus the product it contains can only be viewed from one direction. In addition, the wall-mounted units are permanently mounted and not portable to various locations around the store. Items such as soft drinks, wine, prepared sandwiches and the like might sell much more quickly if the display apparatus could be moved to a location near the checkout counters of a store or other areas of high customer traffic. Marketing with impulse buying is effective only when the customer views the product, and permanently mounted wall units often are located in areas of low customer traffic.

Portable, refrigerated display devices have been proposed to improve the effectiveness of impulse marketing compared to wall-mounted displays. Portable, refrigerated displays generally include a clear housing mounted atop a base having rollers for movement of the display to the desired location. The housing includes a plurality of spaced shelves which are accessible by opening a single door mounted to the housing. Display devices of this type permit 360° viewing of the articles placed therein and are portable.

However, such portable devices also have limitations. The large access doors in their housings must be swung outwardly for removal of articles contained therein. This limits where the display may be positioned because the door could interfere with customer traffic if it opened into an aisle or against a counter or display. In addition, the openings to the refrigerated interior of such portable display devices must be large to permit access to all of the shelves. Unfortunately, these openings allow extensive amounts of ambient air to enter and warm their interiors. As a result, the refrigeration units for such displays usually become inefficient to run, and the clear, glass walls of their housings become fogged with condensed moisture.

SUMMARY OF THE INVENTION

It is therefore among the objects of this invention to provide a refrigerated display apparatus particularly adapted for dispensing articles such as soda cans and the like which is portable, which includes a housing adapted to stack articles in a plurality of vertical columns, which permits 360° viewing of the articles within the housing, which includes a single, relatively small dispensing door to permit positioning of the apparatus in virtually any location in a store without interfering with customer traffic, which includes means for efficiently refrigerating the housing interior, and means for defogging the outer walls of the housing.

These objects are accomplished in an article display apparatus according to this invention including a base support, a housing having a transparent outer, annular wall and a hollow interior, door means mounted to the housing to permit access to the housing interior, means for coolinfg the housing interior and means for defogging the transparent outer wall of the housing. Articles are stacked in vertical columns within the housing interior upon an article support carriage rotatably mounted to the base support beneath the housing. The article support carriage is rotatable with respect to the fixed base support and housing to index each vertical column of articles into alignment with the door means placing the articles in each column in position for removal from the housing interior.

More specifically, in one aspect of this invention, a display apparatus is provided for dispensing food articles such as soda cans stacked in a plurality of vertical columns. The display apparatus includes a housing formed with a transparent, annular outer wall, a top cover and an open bottom. A column support connected to a base is received within the hollow interior and is mounted to the top cover of the housing. The articles are stacked preferably end-to-end in vertical columns within the housing atop an article support carriage which is rotatably mounted to the column support at the open bottom of the housing. The article support carriage includes an insulated plate supported on a lazy-susan-type bearing which is mounted to the support column such that the article support carriage, and the vertical columns of articles it supports, are rotatable with respect to the fixed housing and column support.

Articles, such as soda cans, are mounted in vertical columns atop the article support carriage by a plurality of spaced article supports in the form of vertically-extending fins. The fins are mounted to the article support carriage and extend upwardly to a point near the top cover of the housing. In addition, the fins are spaced apart and shaped so that adjacent fins form a sleeve in which articles, such as soda cans, are received and supported in vertical columns atop the article support carriage. Preferably, the fins are formed of a thermally-conductive material to aid in cooling of the articles as described in more detail below.

A locator member is provided within the housing interior to index the article support carriage so that each vertical column of articles may be aligned with the door means formed in the outer wall of the housing. The article support carriage is rotated by grasping an annular ring mounted to the article support carriage beneath the housing so that the desired vertical column may be indexed in place at the door means for removal of the articles.

In a presently preferred embodiment of this invention, one or more product-mounting pins, hooks or the like are connected to the support column between its base and the housing. It is contemplated that where soda cans are to be dispensed from the display device of this invention, product support pins could be utilized to display various items, such as snack food items, like potato chips, corn chips, etc.

In another aspect of this invention, a door is mounted over an opening in the transparent outer wall of the housing to provide access to the housing interior for removing articles contained therein. The door is movable between an opened position and a closed position. In the opened position, the articles above the lowermost article in the vertical column are clamped or supported in place while the lowermost article is tilted outwardly for removal from the housing interior. As the door is moved to a closed position, with the lowermost article having been removed, the remaining articles in the vertical column are released so that the next article in the column rests atop the article support carriage in a position for removal from the housing interior.

More specifically, the door means of this invention cooperates with a plurality of pivotal article support members, each mounting to the article support carriage and supporting a vertical column of articles, to permit removal of the articles in each column one by one. The door means includes a door panel pivotally mounted over an access opening formed in the transparent outer wall of the housing. When a vertical column is aligned with the access opening, the door panel is operable to pivot the article support member supporting such vertical column between an article support position with the door panel closed, and an article discharge position with the door panel open. In the article support position, the article support member is positioned to support the entire column of articles in vertical alignment. In the article discharge position, the article support member is adapted to tilt the lowermost article forwardly, toward the door panel and access opening, to permit easy removal of the article.

In order to permit removal of the lowermost article in each vertical column without interference from the articles stacked above, the door means of this invention further includes column support means operatively connected to the door panel. The column support means clamps the column of articles immediately above the lowermost article with the door open to permit removal of the lowermost article, and then releases the column of articles onto the article support member when the door is closed.

The access door of this invention provides several advantages. The door panel is relatively small and swings upwardly when opened so that the article display apparatus herein may be positioned in virtually any location around the store without interfering with customer traffic or surrounding displays. In opening the door panel to remove an article, the article is tilted forwardly for easy access by the consumer without being tipped over onto the floor. In addition, the articles in the vertical column above the lowermost article being removed are positively held in place and not released until the door panel is almost closed, thus preventing a child from getting his or her fingers caught beneath the column of articles after they are released.

In another aspect of this invention, a cooling system is provided for refrigerating the articles within the housing interior. The portion of the support column contained in the housing interior is hollow and includes a cooling coil mounted therein which is operated by a motor and compressor contained within the base. A number of air inlet bores are formed in the support column near the base of the housing interior and a like number of air outlet openings are formed in the support column near the top cover of the housing. A blower mounted within the support column is adapted to circulate cooling air into the support column through the air inlet openings, over the cooling coil and then out the air outlet openings. The cooled air is passed over the columns of articles and the fins which mount them in place atop the article support carriage. The articles are thus cooled by the cold circulating air, and by the thermally conductive fins which become cooled by the circulating air during operation of the apparatus herein.

Moisture entering the housing interior through the door condenses on the cooling coil within the support column. The blower is provided with a defrosting cycle in which hot air is passed over the coil for melting the condensate, which is then collected in an evaporator tray mounted in the base of the support column.

In still another aspect of this invention, a system for defogging the transparent outer wall of the housing is provided. The base of the support column is formed with a vent, preferably stamped in a stylized configuration such as a logo or the like, for the receipt of outside ambient air therethrough. The ambient air is drawn over the motor and compressor which heats the ambient air at least to some degree.

A number of outlet openings are formed in the support column beneath the housing which communicate with a conical-shaped flow control plate having an upright outer lip. The flow control plate is mounted to the support column beneath the housing and extends radially outwardly from the support column such that its outer lip is substantially parallel to and spaced from the transparent outer wall of the housing. Air drawn through the vent in the base of the support column flows upwardly through the support column and out the outlet openings to the flow control plate. The flow control plate is operable to direct the heated air along the exterior surface of the transparent outer wall of the housing to prevent condensation of moisture thereon.

DESCRIPTION OF THE DRAWINGS

The structure, operation and advantages of this invention will become further apparent upon consideration of the following description taken in conjunction with the accompanying illustrative drawings, wherein.

DETAILED DESCRIPTION OF THE INVENTION

Figure 1:
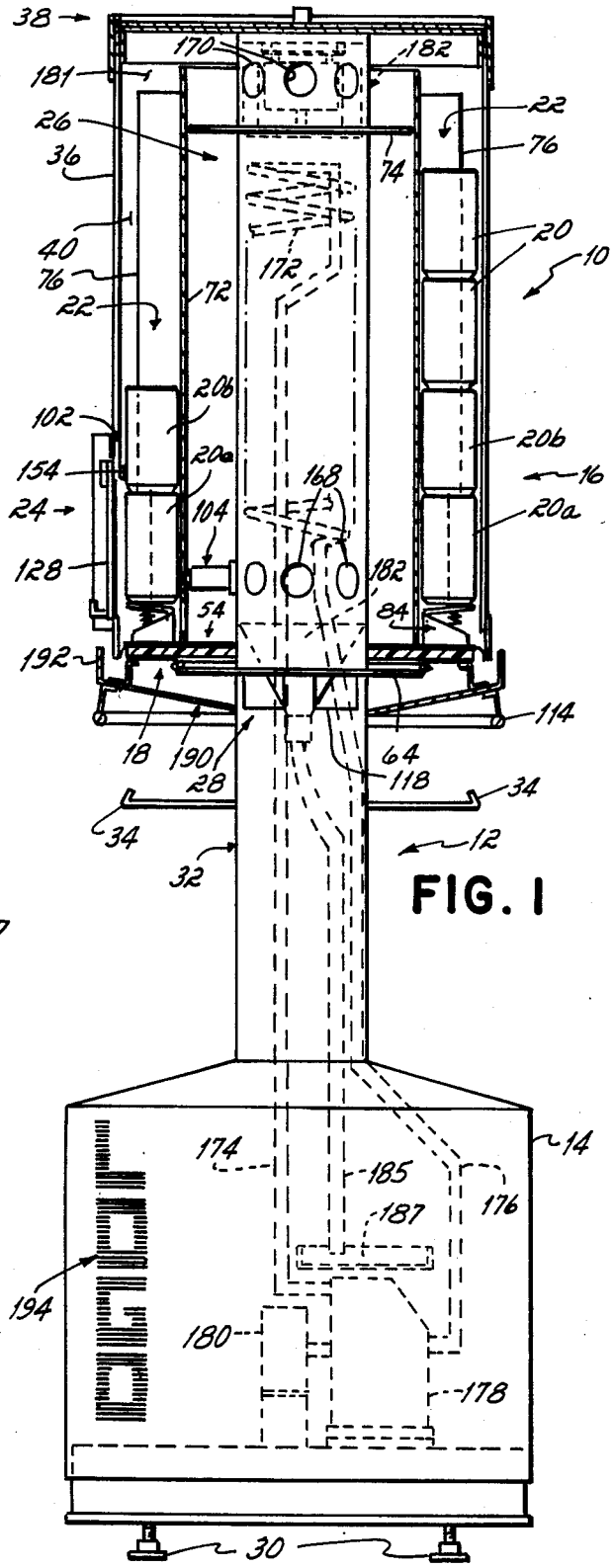
FIG. 1 is a side view in partial cross section of the article display apparatus of this invention.
Figure 2:
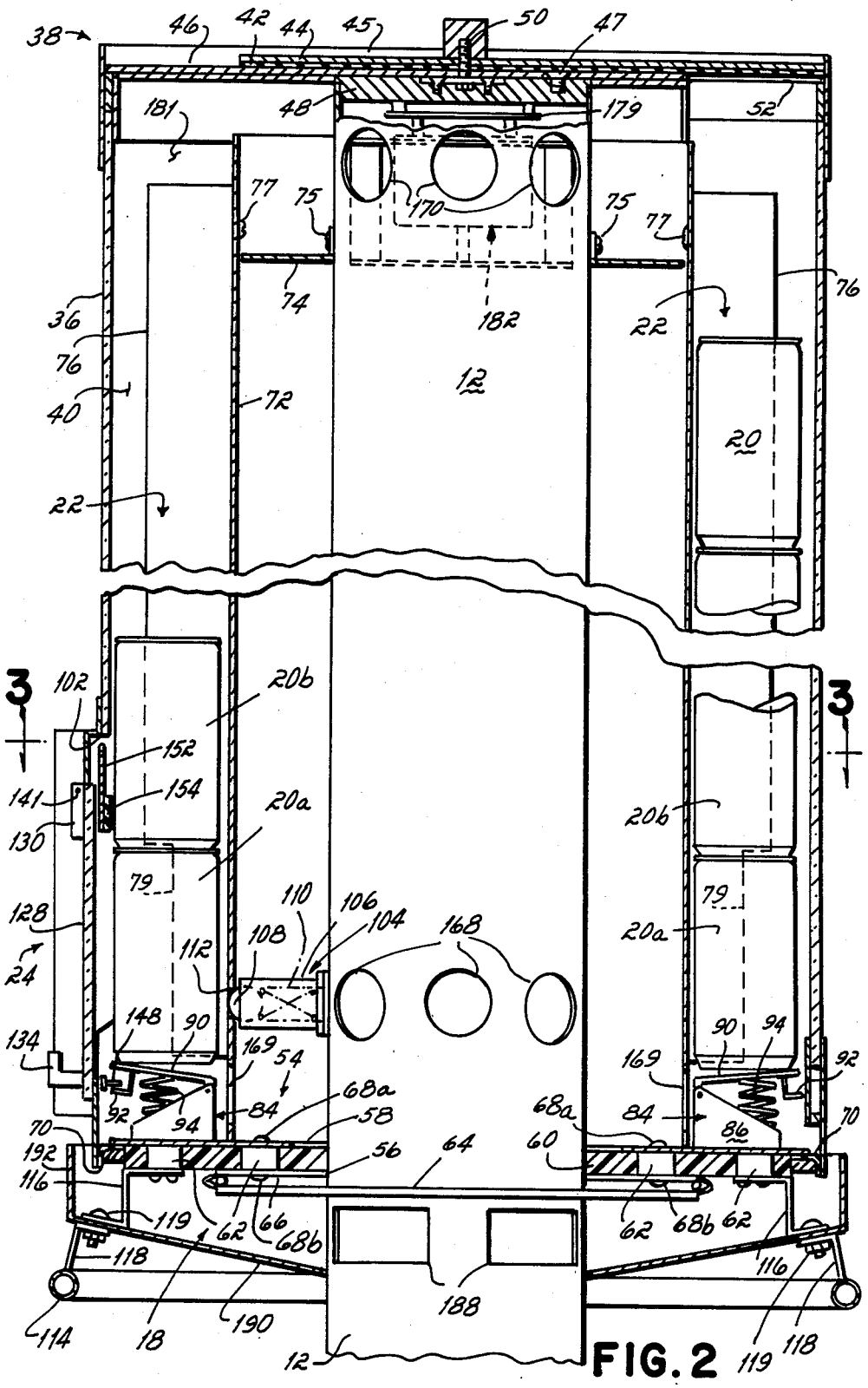
FIG. 2 is an enlarged, partial cut-away side view of the top portion of the display apparatus shown in FIG. 1.

Referring now to FIGS. 1 and 2, the article display apparatus 10 of this invention includes a columnn support 12 having a base 14, a housing 16 mounted atop the column support 12 and an article support carriage 18 rotatably mounted to the column support 12 beneath the housing 16. A plurality of articles 20 such as soda cans are stacked end-to-end in vertical columns 22 atop the article support carriage 18. The article support carriage 18 is rotatable with respect to the fixed column support 12 and housing 16 to index each of the vertical columns 22 into alignment with a door 24 mounted to the housing 16 for removal of the articles 20 therefrom. A refrigeration system 26 maintains the articles 20 cool, and a defogging system 28 prevents the condensation of moisture along the exterior of housing 16.

More specifically, the column support 12 and base 14 are hollow and could be formed of metal, plastic or a similar material. The column support 12 may be formed in a continuous section or multiple sections connected together, and includes a thermal break (not shown) to limit condensation along its exterior from the refrigerated housing 16. The base 14 is supported on the floor by spaced pads 30, although it is contemplated that other supports such as rollers could be utilized. In a presently preferred embodiment, the middle portion 32 of the column support 12, between the housing 16 and base 14, is provided with one or more hooks 34 which are adapted to support food articles such as bags of snacks and the like, housewares, toiletries, and other articles.

The housing 16 includes a transparent, annular outer wall 36, or walls, closed at the top by a cover 38 and open at the bottom to define a hollow interior 40. The outer wall 36 of the housing 16 is preferably formed of transparent plastic, although glass or other suitable transparent materials could also be utilized. In addition, the outer wall 36 can be formed of a single layer of transparent material as shown in the drawings, or spaced, multiple layers separated by an air gap. The housing 16 is mounted atop the column support 12 so that at least a portion of the column support 12 is contained within the hollow interior 40 thereof.

Referring now to FIG. 2, the cover 38 of housing 16 includes an insulating seal 42 sandwiched between a closure plate 44 and a mounting plate 46, and a removable cap 45 mounted atop the plates 44, 46 and extending along the outer wall 36 of housing 16. The mounting plate 46 is secured by screws 47 to a blower mounting plate 48, described in more detail below, to mount the cover 38 atop the column support 12. The closure plate 44 and seal 42 are mounted above the mounting plate 46 by a pivot screw 50 which extends upwardly from the blower mounting plate 48 and also mounts the cap 45 in place.

The closure plate 44 and seal 42 are pivotal with respect to the mounting plate 46 to open and close an article fill opening 52 formed in the mounting plate 46. Articles 20 are stacked in vertical columns 22 within the housing 16 through the article fill opening 52 as described in more detail below. The cover plate 44 and seal 42 closes the fill opening 52 during operation of apparatus 10, as shown in FIG. 2, and are pivotal away from the fill opening 52 to permit article loading.

The articles 20 are supported within the hollow interior 40 of housing 16 by the article support carriage 18. The article support carriage 18 includes an annular support member 54 consisting of a lower, spacer plate 56, an upper plate 58 and a layer 60 of any suitable insulating material mounted therebetween. The insulating layer 60 is provided with a number of spaced plugs 62, formed of a rigid material, for mounting elements of the apparatus 10 to the support member 54 as discussed below. The article support carriage 18 further includes a mounting plate 64 fixed to the column support 12, which supports a bearing 66 preferably of the lazy-susan type. The support member 54 is secured to the bearing 66 by screws 68*a, b* which extend through upper plate 58 into the plug 62.

The support member 54 is mounted for rotation upon the bearing 66 at the open bottom of the housing 16 so that the upper plate 58 of support member 54 forms the bottom surface or floor of the housing 16. The support member 54 is rotatable with respect to the housing 16 on the bearing 66, and a seal 70 is provided between the support member 54 and outer wall 36 of housing 16 to close the hollow interior 40 of housing 16 while permitting rotation of the support member 54.

Figure 3:
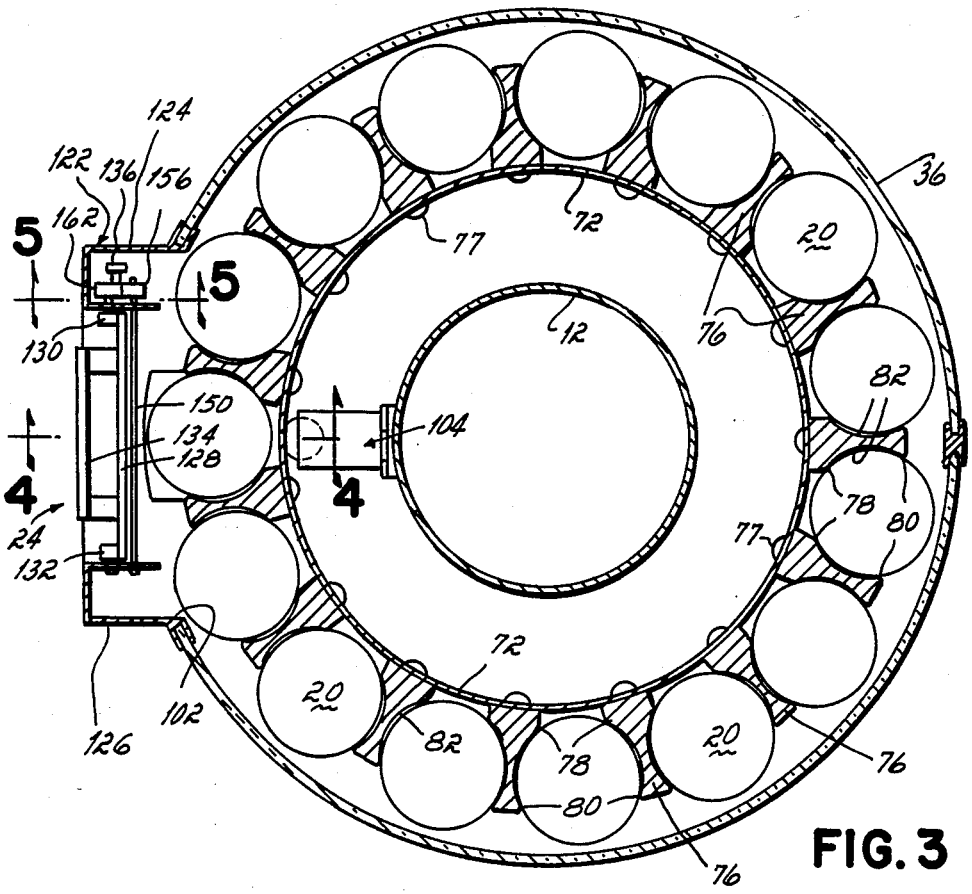
FIG. 3 is a cross sectional view of the top portion of the article display apparatus taken generally along line 3—3 of FIG. 2.

Referring now to FIGS. 2 and 3, the structure for mounting the articles 20 in vertical columns 22 within the housing interior 40 is illustrated. An annular wall 72 is mounted to the support member 54 of article support carriage 18, and extends upwardly concentric to the column support 12 toward the cover 38 of housing 16. The space between the annular wall 72 and column support 12 is closed by a donut-shaped plate 74 mounted by screws 75 to the column support 12 for purposes to become apparent below.

A plurality of article supports in the form of spacers or fins 76 are mounted by screws 77 to the annular wall 72 and extend radially outwardly therefrom toward the outer wall 36 of the housing 16. Each of the fins 76 includes a rearward portion 78 connected to the annular wall 72, a forward portion 80 closest to the outer wall 36 and an arcuate center portion 82 therebetween. Adjacent fins 76 are spaced apart such that the distance between their forward portions 80 is slightly less than the diameter of an article 20 and the distance between their arcuate center portions 82 is slightly greater than the diameter of an article 20 forming a sleeve therebetween. The articles 20 are therefore retained between adjacent fins 76 and must be loaded into the housing 16 vertically through the fill opening 52 in the housing cover 38. Each of the fins 76 are formed with a cut-out 79 near the bottom to permit the removal of an article 20.

Figure 6:
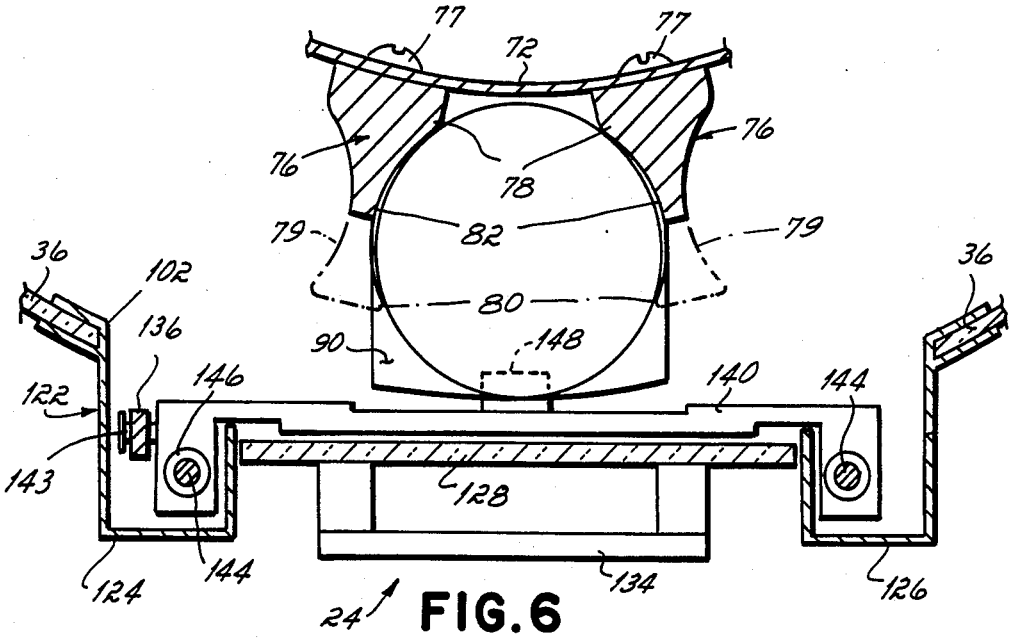
FIG. 6 is a partial plan view, in partial cross section, of the door mechanism of this invention and one of the vertical columns of articles to be removed at the door.

In the embodiment of this invention shown in the figures, fifteen fins 76 are spaced about the annular wall 72 to form fifteen vertical columns 22 of articles 20. It should be understood that the number of vertical columns 22 could be altered as desired by increasing or decreasing the diameter of annular wall 72 and/or the spacing between adjacent fins 76. In addition, articles 20 of different diameter or shape could be accommodated by varying the spacing between adjacent fins 76 and/or the shape of their center portions 82. It should be appreciated that the vertical columns 22 as depicted in FIGS. 3 and 6 are especially suited to accommodate cylindrical articles, such as beverage cans.

Figure 4:
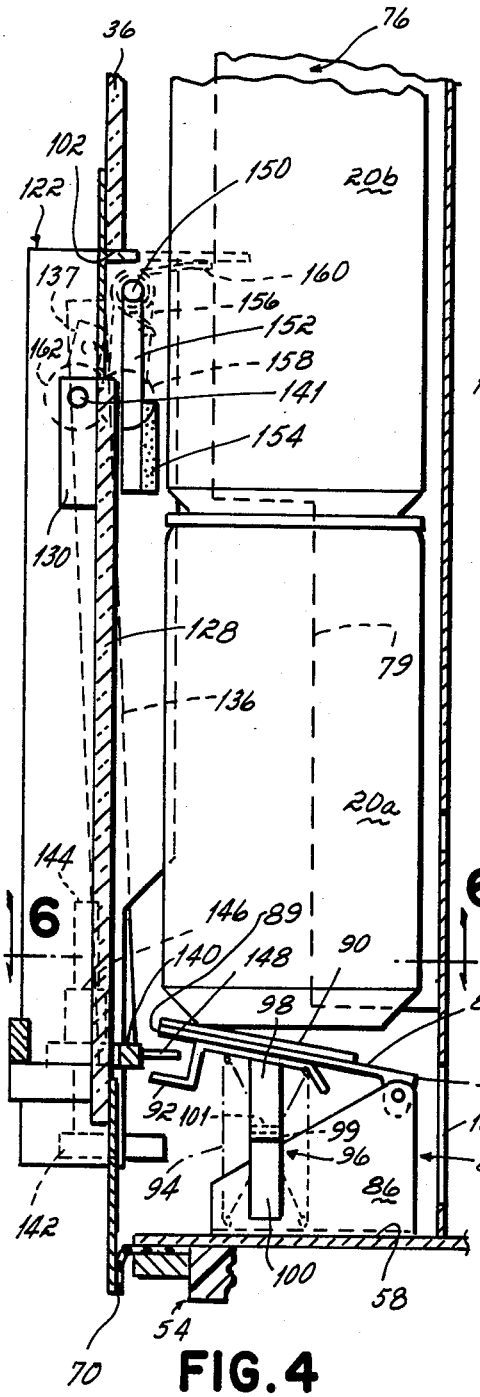
FIG. 4 is an enlarged cross-sectional view of the door of this invention taken generally along line 4—4 of FIG. 3, showing the door in a closed position.
Figure 4A:
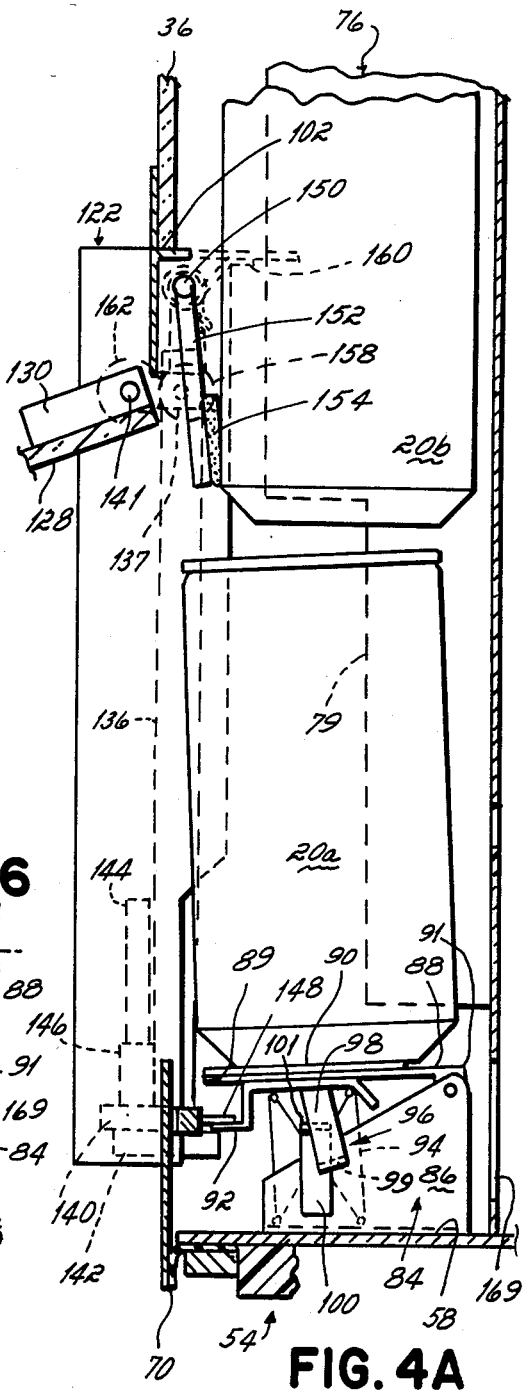
FIG. 4*a* is a view similar to FIG. 4 with the door in an opened position.

As best shown in FIGS. 4 and 4*a*, each vertical column 22 of articles 20 is supported atop the article support carriage 18 by an article support 84. Each article support 84 includes a pair of spaced brackets 86 mounted to the support member 54 of article support carriage 18, and a plate 88 which extends between the brackets 86 and is pivotally mounted thereto. A frictional contact pad 90 formed of vinyl, urethane or a similar material is mounted atop the plate 88 for engaging the base of an article 20, and a flange 92 is mounted beneath the plate 88. The plate 88 is pivotal between an article support position shown in FIG. 4 in which the forward end 89 of plate 88 is spaced above its rearward end 91, and an article removal position shown in FIG. 4*a* in which the forward end 89 of plate 88 is disposed slightly below its rearward end 91. A spring 94 mounted between the support member 54 and plate 88 functions to return the plate 88 from its article removal position to the article support position. The spring 94 also acts as a shock absorber, in combination with the contact pad 90, to absorb noise and shock caused by loading of the articles 20 into the housing 16.

In addition, a stop 96 is provided which comprises an upper L bracket 98 mounted to the flange 92 and a lower L bracket 100 mounted to the support member 54. The upper and lower L brackets 98, 100 are formed with flanges 99, 101, respectively, which engage one another in the article support position shown in FIG. 4 to limit the upward travel of the plate 88 caused by spring 94. The flanges 99, 101 of upper and lower L brackets 98, 100 disengage with the downward movement of plate 88 to its article removal position as shown in FIG. 4*a*.

The article support carriage 18, and, in turn, the vertical columns 22 of articles 20, are rotatable with respect to the fixed column support 12 and housing 16. The transparent outer wall 36 of housing 16 is formed with an access opening 102 near the bottom to permit removal of articles 20 from the housing interior 40. In order to insure that the vertical columns 22 of articles 20 align with the access opening 102, a locator 104 is provided. As shown in FIG. 2, the locator 104 includes a casing 106 extending between the column support 12 and annular wall 72. One end of the casing 106 is mounted to the column support 12 and its opposite end receives a ball 108 which is biased toward the annular wall 72 by a spring 110 contained within the casing 106. The spring-biased ball 108 is adapted to seat within a plurality of spaced locator holes 112 formed in the same horizontal plane in the annular wall 72.

The article support carriage 18 is rotated by an annular ring 114 mounted to the article support carriage 18 by five pairs of upper and lower flanges 116, 118, respectively, connected together by bolts 119, only two of which are shown in FIG. 2. By grasping the annular ring 114, the consumer can rotate the article support carriage 18 so that the desired vertical column 22 of articles 20 is positioned in alignment with the access opening 102 in the outer wall 36 of housing 16. The locator 104 functions to index the article support carriage 18 to the proper position with respect to the access opening 102 so that a selected vertical column 22 of articles 20 directly aligns with the access opening 102.

Figure 5:
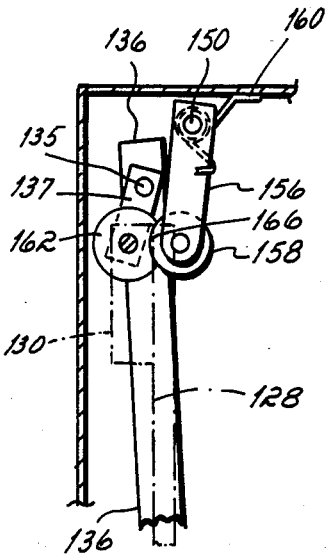
FIG. 5 is a partial cross-sectional view of the door herein taken generally along line 5—5 of FIG. 3 with the door closed.

Referring now to FIGS. 4–6, the door 24 is mounted to the access opening 102 formed in the outer wall 36 of housing 16. The door 24 functions to permit removal of one article 20 at a time from each vertical column 22. As the door 24 is opened, articles 20 above the lowermost article 20*a*, in the vertical column 22 are supported from downward movement. The lowermost article 20*a* is tipped at a slight angle toward the outer wall 36 of housing 16 for easy removal. As the door 24 is closed, the remaining articles 20 in the vertical column 22 are released onto the article support 84 in preparation for the removal of another article 20.

More specifically, the door 24 includes a mounting bracket 122 mounted around the edges of the access opening 102 and having a pair of spaced, inwardly extending mounting flanges 124, 126. The space between mounting flanges 124, 126 is spanned by a door panel 128 which is pivotally mounted to the mounting flanges 124, 126 by a pair of support bars 130, 132. A handle 134 is mounted to the base of door panel 128 for pivoting it between a closed position shown in FIG. 4, and an opened position shown in FIG. 4*a*. As mentioned above, the door 24 must perform two functions. The lowermost article 20*a* must be presented at the access opening 102 for dispensing or removal from the housing 16, and the remaining articles 20 above the lowermost article 20*a* must be maintained in place above the article support 84 until the door panel 128 is closed.

The structure for dispensing the lowermost article 20*a* from the housing 16 is discussed first. A pair of spaced pivot arms 136, 138 are each mounted at their upper ends by a pin 135 to a connector bar 137, which, in turn, is mounted to a rod 141. Only one of the connector bars 137 and rods 141 are shown in the drawings for ease of illustration. The other end of each rod 141 is connected to one of the support bars 130, 132 for pivotal movement therewith. The lower ends of pivot arms 136, 138 are fixed by a pair of pins 143 to opposite ends of a push bar 140 which extends across substantially the entire width of access opening 102 and is held in a generally horizontal position by the pivot arms 136, 138. A pair of pads 142 are fixed to opposite sides of the base of the access opening 102, only one of which is shown in the drawings. Each of the pads 142 mounts an upright, guide rod 144 received within a bore (not shown) formed in the opposite ends of push bar 140. A pair of sleeves 146 are mounted to the push bar 140, and being concentric with each of its bores, which are adapted to slide along a respective guide rod 144. The inner edge of the push bar 140 includes an extension or finger 148 which is adapted to engage the flange 92 of the article support 84.

The door 24 dispenses the lowermost article 20*a* in the following manner. With the door panel 128 in the closed position as shown in FIG. 4, the lowermost article 20*a* rests atop the plate 88 of article support 84. The article support 84 is disposed in its article-support position by L-brackets 98, 100 wherein the forward end 89 of plate 88 is spaced vertically above the rearward end 91 thereof forming an angle, for instance, of approximately 10° with respect to the horizontal. In this position, the finger 148 of push bar 140 is disposed between the plate 88 and flange 92 of article support 84 so that the article support carriage 18 may be rotated relative to the door 24 without interference between the push bar 140 and article support 84.

As the door panel 128 is opened, the support bars 130, 132, and connector bars 137, 139, rotate in a clockwise direction and urge the pivot arms 136, 138 downwardly toward the article support carriage 18. In turn, the push bar 140 is moved downwardly in an essentially vertical path along the guide rod 144. The finger 148 of push bar 140 engages the flange 92 of article support 84 and pivots the article support 84 to its article removal position as shown in FIG. 4*a*. In this position, the forward end 89 of plate 88 is disposed slightly vertically below its rearward end 91 so that the lowermost article 20*a* is titled or tipped slightly forwardly toward the outer wall 36 of housing 16 for easy removal therefrom. The article support 84 is returned to its original position by spring 94 as the door panel 128 is closed.

The angles at which the plate 88 of article support 84 is disposed in both its article support position and article removal position are chosen to permit the efficient dispensing of a lowermost article 20*a*. As illustrated in the drawings, the articles 20 are soda or beverage cans having a beveled bottom surface which at least partially nests within the top surface of the soda can beneath. In order for the lowermost article 20*a* to clear the article 20*b* immediately above, the lowermost article 20*a* must be permitted to more vertically downwardly with respect to the article 20*b*. The angle of the plate 88 in its support position permits sufficient downward movement of the lowermost article 20*a* as the article support 84 moves to a removal position to clear article 20*b* above.

The angle of article support 84 in its support position while permitting clearance between adjacent articles 20*a*, 20*b*, is also small enough to prevent the lowermost article 20*a* from being tipped forwardly out of the housing 16 even when the door panel 128 is lifted quickly. In fact, as the door panel 128 is raised, the angular velocity of the article support 84 actually decreases. The chance of articles 28 tipping out of the housing is further reduced by the angle at which the article support 84 is disposed in its article removal position. Preferably, such angle is less than about 10° causing the lowermost article 21 to tilt only slightly for ease of removal without tipping over, out of the housing 16 and onto the floor.

Before the lowermost article 20*a* is presented at the access opening 102 in the outer wall 36, the articles 20 above in the vertical column 22 must be maintained in position. This aspect of the door 24 herein is also illustrated at FIGS. 4 and 4*a*. A rod 150 is rotatably mounted to the flanges 124, 126 of mounting bracket 122. A plate 152 is fixed to the rod 150 and is pivotal therewith toward and away from the articles 20 in vertical column 22. The plate 152 is preferably provided with a pad 154 of vinyl or other material having a high coefficient of friction. As illustrated in FIGS. 4 and 4*a*, the rod 150 is positioned so that the plate 152 aligns with the article 20*b* immediately above the lowermost article 20*a* in the vertical column 22.

One end of rod 150 is mounted to a connector arm 156 having a roller 158 at its opposite end. The roller 158 is biased by a spring 160 into engagement with a cam 162 mounted on the rod 141, which connects to the support bar 130. The cam 162 is formed with a notch 166 which is adapted to receive the rod 164 with the door panel 128 in its closed position.

Figure 5A:
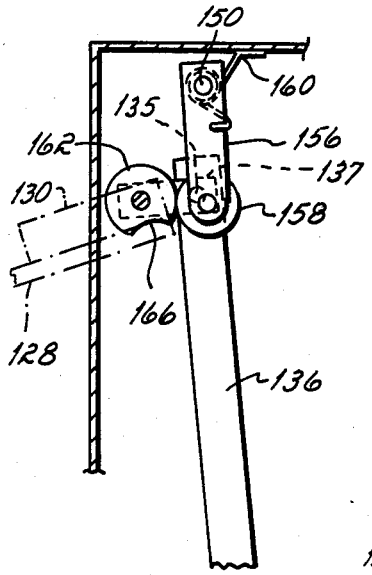
FIG. 5*a* is a view similar to FIG. 5 with the door in an opened position.

As best shown in FIGS. 4–5*a*, the cam 162 is rotated in a clockwise direction in response to opening of the door panel 128. As the roller 158 is unseated from the notch 166 in cam 162, the connector arm 156 is forced rearwardly away from the outer wall 36 of housing 16. This movement pivots the rod 150 so that the pad 154 of plate 152 engages the bottom portion of the article 20*b* immediately above the lowermost article 20*a* in vertical column 22. The plate 152 secures the article 20*b*, and all those above it in vertical column 22, firmly in place while the lowermost article 20*a* is removed from the housing 16.

When the door panel 128 is substantially closed, the roller 158 seats within the notch 166 of cam 162, thereby rotating the rod 150 in the opposite direction to release the pad 152 from engagement with the article 20*b*. In this position of roller 158, the spring 160 functions to maintain the door panel 128 in a closed, sealed position. All of the articles 20 are then allowed to drop downwardly so that the article 20*b* is now the lowermost article atop the article support 84 in a position for dispensing. The notch 166 in cam 162 is preferably formed so that the roller 158 does not seat within the notch 166 until the door panel 128 is nearly in its closed position. This prevents the articles 20 in vertical column 22 from being released prematurely while the door panel 128 is opened sufficiently for a small child to reach into the access opening 102, thereby reducing the chance of injury.

It should be understood that the lowermost article 20*c* need not be removed from the housing 16. If, for example, the customer changes his mind and wishes to make another selection, the door panel 128 is first closed to return the article 20*c* to its original position in FIG. 4, and the housing is then rotated to align another column 22 of articles 20 with the door 26.

Referring now to FIGS. 1 and 2, the cooling system 26 of the article display apparatus 10 herein is illustrated. The portion of column support 12 contained within the housing interior 40 includes a plurality of spaced air inlet openings 168 near the article support carriage 18 and a plurality of air outlet openings 170 near the housing cover 38. A cooling coil 172 is mounted within the hollow column support 12 between the openings 168, 170 and is connected by an inlet and outlet line 174, 176, respectively, to a compressor 178 mounted in the base 14. The compressor 178 is driven by a motor 180 also mounted in the base 14. Mounted atop the cooling coil 172 within the column support 12 is a blower 182 connected by a support 179 to the blower mounting plate 48.

The cooling system of this invention operates as follows. The blower 182 draws air through the inlet openings 168 through at least one return opening 169 formed in the annular wall 72, over the cooling coil 172 and out the outlet openings 170 into the hollow interior 40 of housing 16. The closure plate 74 blocks the flow of cool air into the space between the column support 12 and annular wall 72, so the cool air is directed into the space 181 between annular wall 72 and the outer wall 36 of housing 16. The cooled air therefore flows over not only the articles 20, but also over the fins 76 and the outer surface of annular wall 72 which are disposed within the space 181. This arrangement provides an extremely efficient means for quickly cooling articles 20 within the housing 16. Cooling of the articles 20 is achieved not only by convection by the cooled air, but also by conduction and/or radiation between the cooled, thermally-conductive surfaces of the fins 76 and annular wall 72 and the articles 20.

Moisture introduced into the housing interior 40 through the door 24 condenses on the cooling coil 172. The operation of the blower 182 continues through the defrosting cycle for cleaning the cooling coil 172 of condensate. This moisture is collected beneath the cooling coil 172 by a funnel 182 mounted within the column support 12 thereat. The funnel 182 is connected by a drain line 185 to an evaporator tray 187 disposed within the base 14. The moisture collected in the evaporator tray 187 is evaporated by the heat generated while operating the motor 180 and compressor 178.

The article display apparatus 10 of this invention also includes a defogging system for maintaining the transparent outer wall 36 of housing 16 essentially free from condensation. The column support 12 is formed with four spaced outlet openings 188 beneath the housing 16, only two of which are shown in FIGS. 1 and 2. An annular, conical-shaped plate 190 having an upright outer lip 192 is fixed to the column support 12 beneath the outlet openings 188. The annular plate 190 extends radially outwardly from the column support 12 and tapers upwardly toward the housing 16 so that its upright lip 192 is disposed substantially parallel to the exterior of the outer wall 36 of housing 16. A vent 194 is stamped into the base 14, and is preferably formed in the shape of a logo or other identifying indicia.

The defogging system of the instant invention operates by drawing outside air through the vent 94 and over the heated, operating compressor 174 and motor 176. This heats the ambient air to some degree and it travels upwardly through the hollow column support 12 and out the outlet openings 188. The heated air is then directed by the annular plate 190 radially outwardly from the column support 12 to the upright lip 192 of annular plate 190 where the air stream is turned upwardly between upright lip 192 and the base of the door mounting bracket 122. The air stream is thus directed vertically upwardly along the exterior surface of the outer wall 36 of housing 16 to prevent moisture from accumulating thereon and obstructing a view of the housing interior 40.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, although the housing 16 was illustrated in the drawings as having an annular outer wall 36, it is contemplated that square, rectangular or other shaped outer walls could be utilized in accordance with the teachings of this invention. In addition, it is contemplated that articles other than the soda or beverage cans illustrated herein could be dispensed from the apparatus of this invention.

It is also contemplated that the door 24 herein could be modified to perform essentially the same function as described above; that being, to clamp the articles in the vertical column above the lowermost article to be removed and to present the lowermost article for removal so that it clears the articles above. As described and illustrated in the drawings, the lowermost article **20*a* is moved downwardly to clear the article 20*b* above, and then lifted outwardly for dispensing. At the same time, the article 20*b* is clamped against the fins 76 to support the remaining articles 20 in the vertical column. Other mechanisms for performing these functions may also be utilized. For example, means could be provided for not only clamping article 20*b* but lifting it, and the articles 20 stacked above, upwardly to provide clearance for removal of the lowermost article 20*a*. In this embodiment, the lowermost article 20*a* would remain stationary prior to removal from housing 16. In addition, the lowermost article 20*a* need not be tilted forwardly to clear the article 20*b*** above, only vertically downwardly.

Therefore, it is intended that the invention not be limited to the particular embodiment disclosed as the best mode contemplated for carrying out this invention, but that the invention will include all embodiments falling within the scope of the appended claims.

What is claimed is:

1. An article display apparatus comprising:

a base support;

a housing having an outer wall and a hollow interior, said housing being mounted to said base support;

an article support carriage mounted to said base support beneath said housing, said article support carriage being adapted to support articles in vertical columns within said hollow interior of said housing;

door means mounted to said outer wall of said housing, said door means being movable between an open position for permitting removal of articles from said housing and a closed position;

said door means being operable upon movement to said open position to move the lowermost article in at least one of said vertical columns from a support position beneath the remaining articles in said vertical column to an unloading position to permit removal of said lowermost article from said housing, and to simultaneously engage the next article in said vertical column immediately above said lowermost article to support the remaining articles in said vertical column;

said door means being operable upon movement from said open position to said closed position to place said next article in said support position beneath the remaining articles in said vertical column; and cooling means for cooling said hollow interior of said housing.

2. The article display apparatus of claim 1 further including locator means for indexing said article support carriage with respect to said housing to directly align each of said vertical columns of articles with said door means upon rotation of said article support carriage relative to said housing and said base support.

3. The article display apparatus of claim 2 further including an annular wall mounted to said article support carriage within said housing, said annular wall being formed with a plurality of spaced bores in the same horizontal plane, said locator means comprising a spring-biased ball mounted within a casing connected at one end to said base support, said spring-biased ball being receivable within each of said spaced bores for locating a column of articles in alignment with said door means upon rotation of said article support carriage relative to said housing.

4. The article display apparatus of claim 1 further including positioner means for rotating said article support carriage with respect to said housing and said base support.

5. The article display apparatus of claim 4 in which said positioner means comprises an annular ring mounted to said article support carriage, said annular ring being adapted to be grasped by hand for rotating said article support carriage relative to said housing and said base support.

6. The article display apparatus of claim 1 in which said housing is formed with an open bottom, said article support carriage comprising a bearing mounted for rotation to said base support, and an article support member mounted to said bearing at said open bottom of said housing.

7. The article display apparatus of claim 6 in which said article support includes an annular section of insulating material sandwiched between a spacer plate and a top plate, a plurality of plugs being spaced within said annular section of insulating material to receive fasteners for mounting said article support to said bearing.

8. The article display apparatus of claim 6 further including a seal extending between said article support and said outer wall of said housing for creating a seal therebetween while permitting rotation of said article support relative to said housing.

9. The article display apparatus of claim 1 further including:

an annular wall mounted to said article support carriage, said annular wall being disposed within said housing and spaced from said outer wall thereof; and a plurality of spaced, vertically extending fins mounted to said annular wall and extending radially outwardly toward said outer wall of said housing, said fins being adapted to support articles stacked in vertical columns within said space between said annular wall and said outer wall of said housing.

10. The article display apparatus of claim 9 in which said articles are cylindrical cans, each of said fins having a rearward portion connected to said annular wall, a forward portion and an arcuate middle portion, said fins being mounted to said annular wall so that said forward portions of adjacent fins are spaced a distance less than the diameter of said cans and said arcuate middle portions of adjacent fins are spaced a distance greater than the diameter of said cans.

11. The article display apparatus of claim 10 in which said fins are formed of a thermally-conductive material.

12. The article display apparatus of claim 9 in which said housing includes a top panel formed with an access opening to permit loading of articles into said housing between adjacent fins.

13. The article display apparatus of claim 12 further including a cover pivotally mounted to said top panel of said housing, said cover being movable to open and close said access opening in said top panel.

14. The article display apparatus of claim 1 further including means mounted to said base support beneath said housing for displaying products.

15. The article display apparatus of claim 1 in which said base support includes a column support and a base, said base having a hollow interior adapted to enclose a motor and compressor, said base being formed with a vent having a styalized configuration to permit the ingress of air into said base to cool the motor and compressor.

16. The article display apparatus of claim 1 in which said base support includes a support column having a portion at least partially received within said housing, said cooling means comprising:

a cooling coil mounted to said portion of said support column received within said hollow interior of said housing;

condenser means mounted to said base support for supplying coolant to said cooling coil;

blower means mounted to said base support for circulating air over said cooling coil and within said hollow interior of said housing to cool articles supported therein.

17. The article display apparatus of claim 16 in which said portion of said support column received within said hollow interior of said housing is hollow and formed of a thermally-conductive material, said hollow support column being formed with air inlet flow passageways and air outlet flow passageways, said cooling means comprising:

a cooling coil mounted within said hollow interior of said support column;

condenser means for supplying coolant to said cooling coil;

blower means mounted within said hollow interior of said support column for circulating air from said air inlet passageways, over said cooling coil, to said air outlet passageways and within said hollow interior of said housing, said circulated air being cooled by said cooling coil for cooling articles supported within said hollow interior of said housing.

18. The article display apparatus of claim 17 further including collector means for collecting moisture from the air circulated within said support column and condensed on said cooling coil, said collector means including a funnel mounted beneath said cooling coil with said support column, and a tray connected by a drain line to said funnel.

19. The article display apparatus of claim 16 further including a plurality of spaced fins mounted to an annular wall disposed within said hollow interior of said housing for supporting articles in stacked, vertical columns, said fins and annular wall each being formed of thermally-conductive material, said cooling means comprising:

a cooling coil mounted to said portion of said support column received within said hollow interior of said housing;

condenser means for supplying coolant to said cooling coil;

blower means for circulating air over said cooling coil and within said hollow interior of said housing to form cooled air;

said thermally-conductive fins and annular wall being cooled by said cooled, circulating air, the articles supported within said hollow interior of said housing being cooled by said circulating air and said cooled fins and annular wall.

20. An article display apparatus of claim 1 further including means for rotating one of said article support carriage and said housing with respect to the other.

21. An article display apparatus of claim 1 wherein said outer wall is transparent, said article display apparatus further including defogging means for defogging said transparent outer wall of said housing.

22. The article display apparatus of claim 21 in which said base support includes a hollow support column having a base, said hollow support column being formed with spaced outlet openings beneath said housing and said base being formed with a vent, said defogger means comprising:

blower means for drawing air into said base through said vent, upwardly within said hollow support column and then out said spaced outlet openings beneath said housing;

flow control means for directing air from said spaced outlet openings to the exterior surface of said transparent outer wall of said housing.

23. The article display apparatus of claim 22 in which said flow control means includes an annular conical-shaped plate formed with an upright outer lip, said plate being mounted to said hollow support column beneath said spaced outlet openings, said annular plate tapering upwardly from said hollow support column toward said housing so that said upright lip thereof extends substantially parallel to the outer surface of said transparent wall of said housing for directing air therealong.

24. An article display apparatus comprising:

a base support;

a housing having an outer wall and a hollow interior, said housing being mounted to said base support;

an article support carriage mounted to said base support beneath said housing, said article support carriage being adapted to support articles in vertical columns within said hollow interior of said housing;

means for rotating one of said article support carriage and said housing with respect to the other;

door means mounted to said transparent outer wall of said housing and movable between an open and closed position;

said door means being operable in said open position to permit removal of the lowermost article in at least one of the vertical columns from said hollow interior of said housing while supporting the remaining articles in said vertical column above the lowermost article;

said door means being operable upon removal of said lowermost article and movement to the closed position to release the remaining articles in said vertical column onto said article support carriage.

25. The article display apparatus of claim 24 further including an article support means mounted atop said carriage for supporting each of said vertical columns, said article support means comprising:

a plurality of pairs of spaced brackets mounted to said carriage;

a plate connected between each of said pairs of brackets and being adapted to support a vertical column of articles, said plate being pivotal with respect to said brackets between an article support position and an article removal position;

a spring connected between said carriage and said plate for returning said plate from said article removal position to said article support position.

26. The article display apparatus of claim 25 further including stop means for limiting said pivotal movement of said plate at said article support position.

27. The article display apparatus of claim 25 further including a pad mounted atop said plate for frictionally engaging articles in said vertical columns.

28. The article display apparatus of claim 25 in which said plate includes an outer edge disposed proximate said transparent outer wall of said housing and an opposed inner edge, said plate being disposed at an angle in said article support position such that said outer edge is vertically above said inner edge, said plate being disposed at an angle in said article removal position such that said outer edge is slightly vertically below said inner edge, the lowermost article in said vertical column thereby being tipped toward said outer wall of said housing with said plate in said article removal position for easy removal from said hollow interior of said housing.

29. The article display apparatus of claim 24 further including an article support means mounted atop said carriage for supporting each of said vertical columns, said article support means being pivotal between an article support position and an article removal position, and transparent outer wall of said housing being formed with an opening, said door means comprising:

a door panel;

means for pivotally mounting said door panel over said opening in said transparent outer wall of said housing, said door panel being movable between an open and a closed position;

pivot means operatively connected to said door panel for pivoting said article support means between said article support position with said door panel closed, and said article removal position with said door panel open;

column support means operatively connected to said door panel for supporting articles above the lowermost article in each said vertical columns with said door panel open, and for releasing said articles above the lowermost article upon closing said door panel.

30. The article display apparatus of claim 29 further including a mounting bracket connected to said outer wall of said housing at said opening thereof, said pivot means comprising:

a pair of spaced support bars pivotally mounted to said mounting bracket, said door panel extending between and being mounted to said support bars;

a pair of spaced connector bars each mounted to one of said support bars;

a pair of spaced pivot arms each having an upper end connected to one of said connector bars;

a push bar connected between the lower ends of said pivot arms, said push bar being adapted to engage said article support means;

said support bars and said connector bars being pivotal in one direction in response to opening of said door panel to move said pivot arms and in turn said push bar downwardly so that said push bar engages and moves said article support means to said article removal position;

said support bars and said connector bars being pivotal in the opposite direction in response to closing of said door panel to move said pivot arms and in turn said push bar upwardly so that said push bar clears said article support means.

31. The article display apparatus of claim 30 in which said column support means comprises:

a rod pivotally mounted to said mounting bracket;

a plate fixed to said rod, said pad being pivotal with said rod between a vertical position in which said plate is spaced from said vertical column of articles, and an angled position in which said plate engages the article immediately above the lowermost article in said vertical column to support the articles thereabove; and pivot means operatively connected to said door panel for pivoting said rod and plate between said vertical and angled positions.

32. The article display apparatus of claim 31 in which said pivot means comprises:

a cam connected to one of said support bars for mounting said door panel;

a connector arm fixed to said rod;

a roller pivotally mounted to said connector arm and contacting said cam;

said cam being rotatable with said support bar for pivoting said roller, connector arm and rod between said vertical position and said angled position.

33. The article display apparatus of claim 32 in which said cam is formed with a notch adapted to receive said roller, said roller seating within said notch with said door panel closed.

34. The article display apparatus of claim 32 further including a spring connected between said mounting bracket and said connector arm for urging said roller against said cam and for securing said door panel in a closed position.

35. A method of dispensing articles stacked end-to-end in vertical columns from a housing having an access opening covered by door means movable between an open position and a closed position, comprising:

aligning one of the vertical columns of articles with the access opening in the housing;

supporting the articles in the vertical column above the lowermost article therein and simultaneously placing the lowermost article at the access opening in the housing for removal from the housing by moving the door means from a closed position to an open position;

removing the lowermost article from the housing;

moving the door means from an open position to a closed position to release the remaining articles in the vertical column.

36. A method of claim 35 further including the step of tilting the lowermost article at the access opening outwardly from the housing upon separation of the lowermost article from the immediately adjacent article in the vertical column prior to said removal.

37. An article display apparatus for promoting the buying of retail items, comprising:

a base support;

a housing having an outer wall and a hollow interior, said housing being mounted to said base support;

an article support carriage mounted within said housing, said article support carriage being adapted to support articles within said hollow interior of said housing;

door means mounted to said housing for permitting removal of articles from said hollow interior;

cooling means for cooling said hollow interior of said housing; and means exteriorly fixed to said base support or said housing for supporting and displaying a plurality of products outside of said base support or said housing.

38. An article display apparatus of claim 37 wherein said base support comprises an elongated column formed with a base, said housing being mounted to the elongated column.

39. An article display apparatus of claim 38 wherein said article support carriage further includes vertical columns for supporting articles vertically within the hollow interior of said housing.

40. An article display apparatus of claim 38 wherein said mounting means is mounted to the elongated column of said base support beneath said housing.

41. An article display apparatus of claim 37 wherein said article support carriage is mounted to said base support.

42. An article display apparatus of claim 41 further including means for rotating one of said article support carriage and said housing with respect to the other.

43. An article display apparatus of claim 37 wherein said door means is mounted to the outer wall of said housing.

44. An article display apparatus of claim 37 wherein the outer wall is transparent.

* * * * *